US006932710B1

(12) United States Patent
Hartin

(10) Patent No.: US 6,932,710 B1
(45) Date of Patent: Aug. 23, 2005

(54) BOARD SWING

(76) Inventor: William T. Hartin, 977 E. Thompson Blvd., Ventura, CA (US) 93001

( * ) Notice: Subject to any disclaimer, the term of this patent is extended or adjusted under 35 U.S.C. 154(b) by 9 days.

(21) Appl. No.: 10/943,167

(22) Filed: Sep. 15, 2004

(51) Int. Cl.[7] ..... A63G 9/00
(52) U.S. Cl. ..... 472/118; 472/120
(58) Field of Search ..... 472/118, 120, 121, 472/122, 125; 482/23; 434/247

(56) References Cited

U.S. PATENT DOCUMENTS

| | | | | |
|---|---|---|---|---|
| 2,539,869 A | | 1/1951 | Sickelsteel | |
| 2,795,423 A | * | 6/1957 | Fagergren | 482/23 |
| 3,145,013 A | | 8/1964 | Grunoski | |
| 3,276,777 A | | 10/1966 | Pruitt | |
| 3,936,047 A | | 2/1976 | Brandt et al. | |
| 5,163,828 A | | 11/1992 | Coddington, Jr. | |
| 5,178,590 A | * | 1/1993 | Stephens | 482/43 |
| 5,393,268 A | * | 2/1995 | Cunard et al. | 472/120 |
| 5,509,871 A | | 4/1996 | Giovanni | |
| 6,168,551 B1 | | 1/2001 | McGuinness | |
| 6,261,206 B1 | * | 7/2001 | Kranz et al. | 482/23 |
| 6,277,028 B1 | * | 8/2001 | Liu | 472/118 |
| 6,368,227 B1 | | 4/2002 | Olson | |

* cited by examiner

*Primary Examiner*—Kien Nguyen
(74) *Attorney, Agent, or Firm*—Jack C. Munro

(57) ABSTRACT

A board swing which utilizes a pair of somewhat flexible side frame members which are interconnected by a top rail with this top rail being spaced from the supporting surface on which the side frame members rest. An elongated board is mounted by a pair of flexible side members onto the top rail by a pair of pivot means. The elongated board is capable of swinging longitudinally relative to the top rail and is also capable of swinging side-to-side toward and away from the side members. The top rail is pivotable relative to the side members. There may be included a safety member that extends between the pivot means that mounts the flexible supports onto the top rail.

7 Claims, 8 Drawing Sheets

Fig. 11.A

BOARD SWING

BACKGROUND OF THE INVENTION

1. Field of the Invention

This invention relates to a human entertainment device and more particularly to a swing apparatus that is designed to be used principally by young people to simulate the riding of a surfboard or snowboard.

2. Description of the Related Art

Young people have long utilized swings of various types. Typically, a swing comprises a seat which is mounted by chains or ropes to a fixed structure, such as a tree limb. Also, swings have been designed as a self standing unit composed of a tubular frame with the swing mounted on an overhead top rail.

There has been practically no innovation over the last fifty to one hundred years in the construction of swings. Most all swings have operated in the same way with the human rider located in a sitting position. There have been some attempts to design a swing where the rider is permitted to be located in a standing position. However, these swings have not operated with any great degree of satisfaction as the swing will not move as a unit but would tend to become disjointed with the lower portion of the swinging flexing relative to the upper portion of the side frame members of the swing. This type of disjointed action does not produce a desirable entertaining ride.

The sports of surfing and snowboarding provide thrills that are highly desired by most young people. If a swing could be constructed to simulate these sports, such a swing would be highly sought after by young people.

SUMMARY OF THE INVENTION

A first basic embodiment of swing apparatus which utilizes a frame comprising a pair of spaced apart side frame members which are to be mounted on a supporting surface and a top rail member which connects between the side frame members. The top rail member is to be spaced from the supporting surface forming an air space therebetween which is also located between the side frame members. An elongated board has attached thereto at opposite ends thereof flexible supports each of which are pivotally mounted by pivot means to the top rail. A safety member extends between the spaced apart pivot means and is located between the flexible supports. The safety member is adapted to be grasped by a human standing on the elongated board while swinging relative to the frame.

A further embodiment of the present invention is where the first basic embodiment is modified by defining the safety member as being flexible.

A further embodiment of the present invention is where the just previous embodiment is modified by defining that the safety member is constructed of a bendable tube through which is conducted a chain.

A further embodiment of the present invention is where the first basic embodiment is modified by the pivot means being constructed to permit the flexible supports to pivot in a first plane and in a second plane which is perpendicular to the first plane where the first plane permits side-to-side directional movement of the elongated board and the second plane permits longitudinal movement of the elongated board.

A further embodiment of the present invention is where the first basic embodiment is modified by having the top rail pivot relative to the side frame members.

A further embodiment of the present invention is where the first basic embodiment is modified by defining that the flexible supports are constructed by including a combination of a chain and a strap.

A further embodiment of the present invention is where the first basic embodiment is modified by defining that the elongated board is constructed of an interior tubular rigid member frame covered with a plastic foam.

A second basic embodiment of the present invention is directed to a board swing apparatus which is constructed of a frame comprising a pair of spaced apart side frame members which are to be mounted on a supporting surface and top rail member which connects between the side frame members with the top frame member to be spaced from the supporting surface forming an air space therebetween which is also located between the side frame members. An elongated board has a pair of flexible supports attached thereto with the flexible supports being mounted by a pivot means relative to the top rail. The top rail is defined as being pivotable relative to the side frame members.

A further embodiment of the present invention is where the second basic embodiment is modified by defining the pivot means as permitting the flexible supports to pivot in a first plane and a second plane which is perpendicular to the first plane with the first plane permitting side-to-side directional movement of the elongated board and the second plane permitting longitudinal movement of the elongated board.

A further embodiment of the present invention is where the second basic embodiment is modified by defining that each of the flexible supports is constructed of a combination of a chain and a strap.

A further embodiment of the present invention is where the second basic embodiment is modified by defining that the elongated board is constructed of an interior tubular rigid member frame covered with a plastic foam.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 11A is an enlarged view of the pivot mounting for the swing apparatus of FIG. 11 taken along line 11A—11A of FIG. 11.

DETAILED DESCRIPTION OF THE INVENTION

Figure 1:
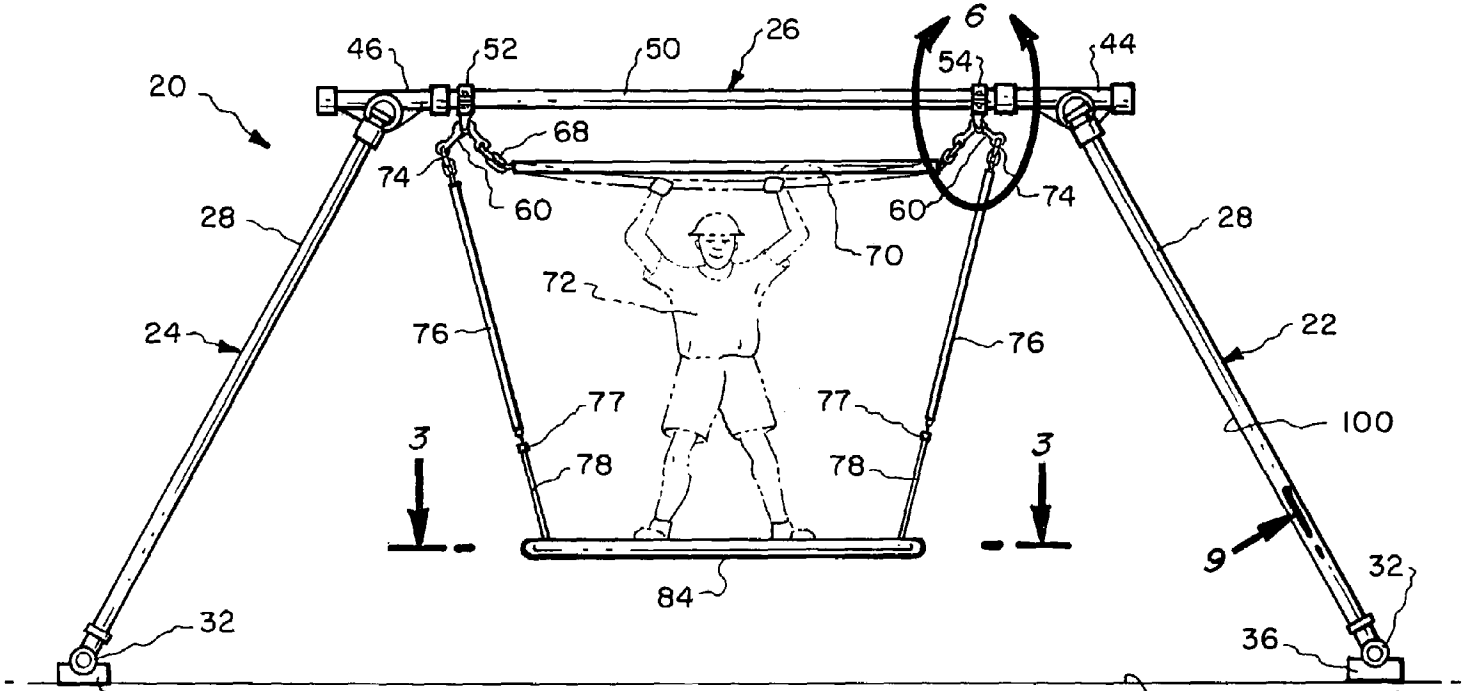
FIG. 1 is a front elevational view of a first embodiment of swing apparatus of the present invention showing the position of a human rider in conjunction with the apparatus.
Figure 4:
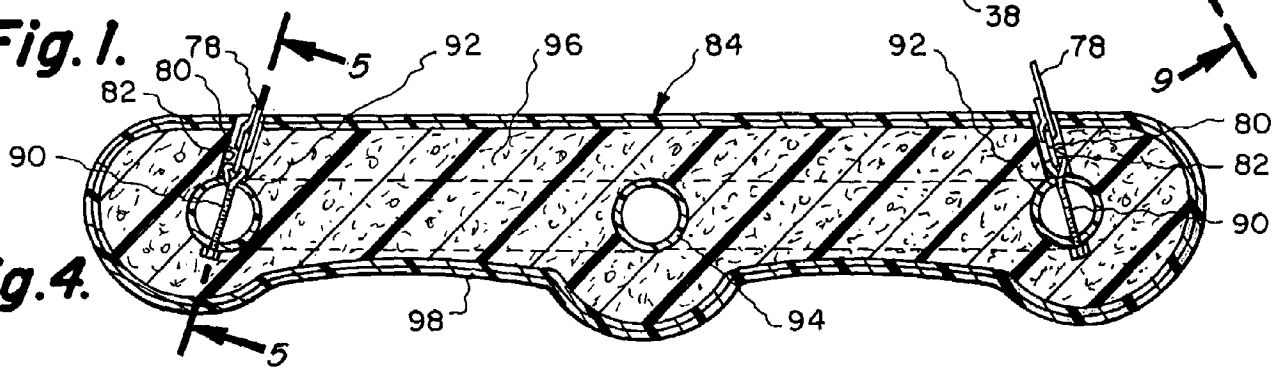
FIG. 4 is a cross-sectional view taken along line 4—4 of FIG. 3 showing in more detail the internal construction of the elongated board.

Referring particularly to FIGS. 1–10 of the drawings, there is shown the basic embodiment 20 of board swing apparatus of this invention. The basic embodiment 20 includes a pair of side frame members 22 and 24 which are interconnected by a top rail 26. Each of the side frame members 22 and 24 are constructed identically and are each composed of a pair of angularly disposed rigid tubes 28 and 30 the outer ends of which are connected by a base tube 32 which is also rigid. Extending between the top rail 26 and the mid-point of the base tube 32 is a vertical support tube 34 which is also rigid. Each base tube 32 is to be fixedly mounted by a plastic base 36 to the supporting surface 38. A typical supporting surface could be dirt, cement, asphalt, gravel and possibly even wood. Also, the board swing apparatus could be mounted on floatation members, and floated on water. Contained within each of the hollow tubes 28, 30 and 32 is a reinforcing member 40. Typical material of construction for reinforcing member 40 could comprise a wood dowel, fiberglass bar or metallic tube. The reason for the reinforcing members 40 is to provide rigidity to the tubes 28, 30 and 32 which will typically be constructed of a plastic material, such as polyvinylchloride, which are subject to bending. It is desirable to have the tubes 28, 30 and 32 to be rigid but somewhat flexible. Appropriate connectors are utilized to connect the different segments of the tubes 28, 30 to the base tube 32. The top rail 26 also includes a reinforcing member 42 which again will normally be constructed of steel or other hard metal. The top rail 26 includes end connectors 44 and 46 also constructed of hard metal. End connector 44 is fixedly secured to the tube 28 of the side frame member 22 with the end connector 46 being fixedly secured to the tube 28 of the side frame member 24. The exterior surface of the reinforcing member 42 could be wrapped with a low frictional tape 48. Extending between the end connectors 44 and 46 and located about the reinforcing member 42 is an outer tube 50 of the top rail 26. The tube 50 is rotatable relative to the reinforcing member 42. Ease of rotation of outer tube 50 is facilitated by the tape 48.

Fixedly mounted on the reinforcing member 42 and located between end connector 44 and the outer tube 50 and also between end connector 46 and the outer tube 50 is a thrust collar 86. Each thrust collar 86 is fixedly secured to the reinforcing member 42 by means of a set screw 88. The purpose of the thrust collar 86 is to keep the rotatable outer tube 50 centered in position and basically prevent longitudinal movement of the outer tube 50.

Fixedly mounted on the outer tube 50 are a pair of spaced apart support brackets 52 and 54. The support brackets 52 and 54 are identical and each comprise a pair of halves which are fixedly secured together by means of bolt fasteners 56. Each support bracket 52 and 54 includes a hole 58. Conducted through each hole 58 is an L-shaped member 60. At the apex of the L is located a bearing 62. The bearing 62 supports the L-shaped member 60 so that it can freely pivot on the bracket 52 or 54 on which it is mounted. The free ends of the L-shaped member 60 includes similar bearings 64 and 66.

Each of the bearings 64 is to connect with an ending link of a chain 68. The purpose of the bearings 64 is to permit free pivotable movement of the chain 68 relative to each of the L-shaped members 60. The chain 68 connects between each of the L-shaped members 60. Mounted on the chain 68 is a tube 70. The tube 70 and the chain 68 comprise a safety member which is adapted to be grasped by the hands of the human rider 72. The safety member is to be used by the rider to steady himself or herself when riding. The safety member is flexible by using of the tube 70 and chain 68.

Figures 2, 3:
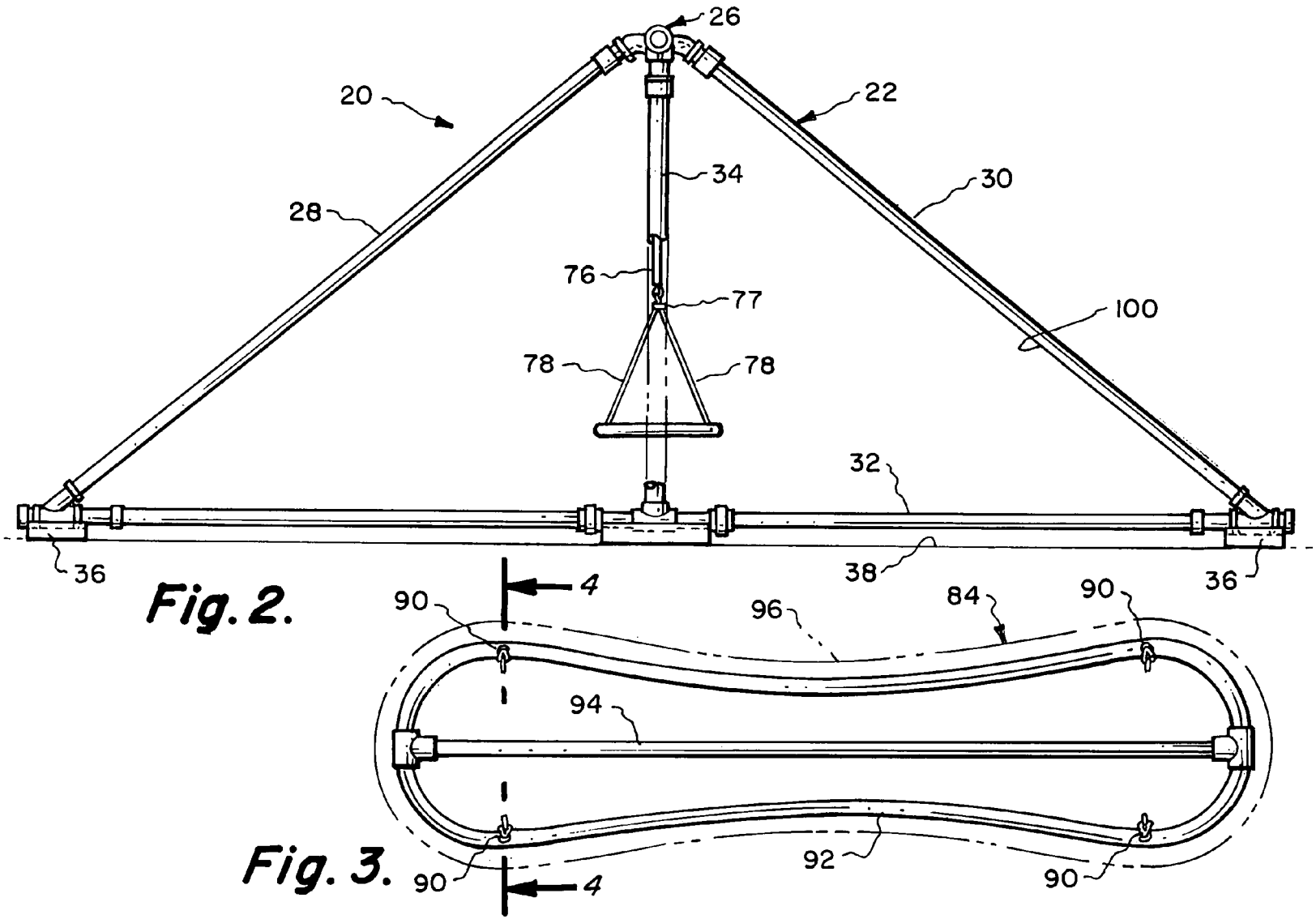
FIG. 2 is a side elevational view of the swing apparatus of FIG. 1.
FIG. 3 is a top plan view of the elongated board utilized in conjunction with the swing apparatus of the present invention taken along line 3—3 of FIG. 1 showing the internal construction of the elongated board.
Figure 9:
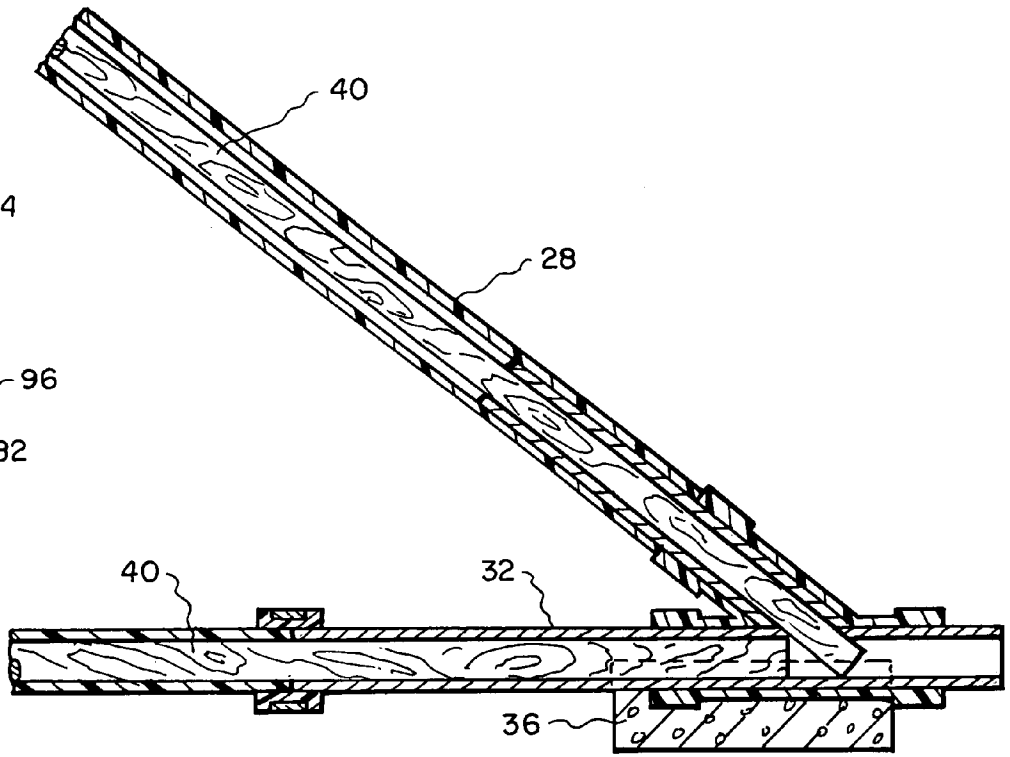
FIG. 9 is a cross-sectional view through a portion of the frame taken along line 9—9 of FIG. 1.
Figure 5:
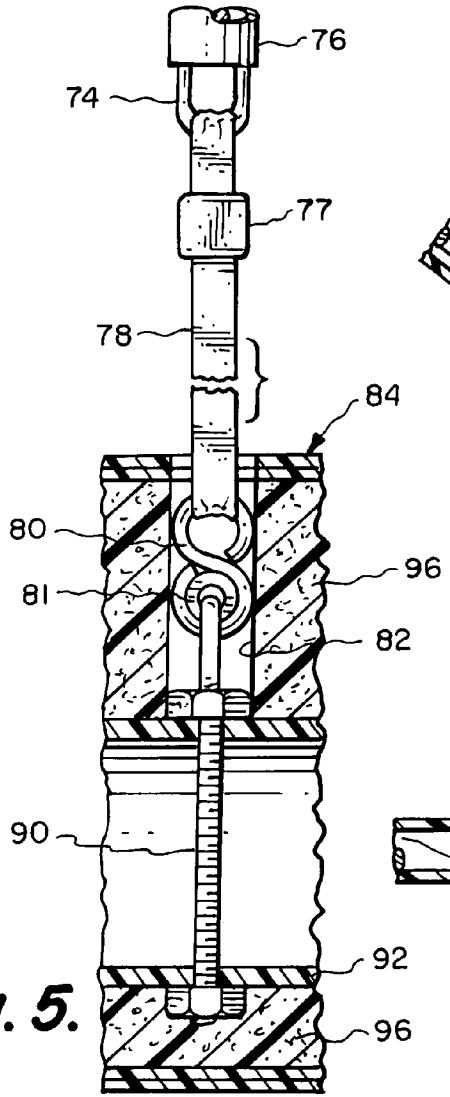
FIG. 5 is a cross-sectional view taken along line 5—5 of FIG. 4 showing the attachment between the side frame members in conjunction with the elongated board.
Figure 6:
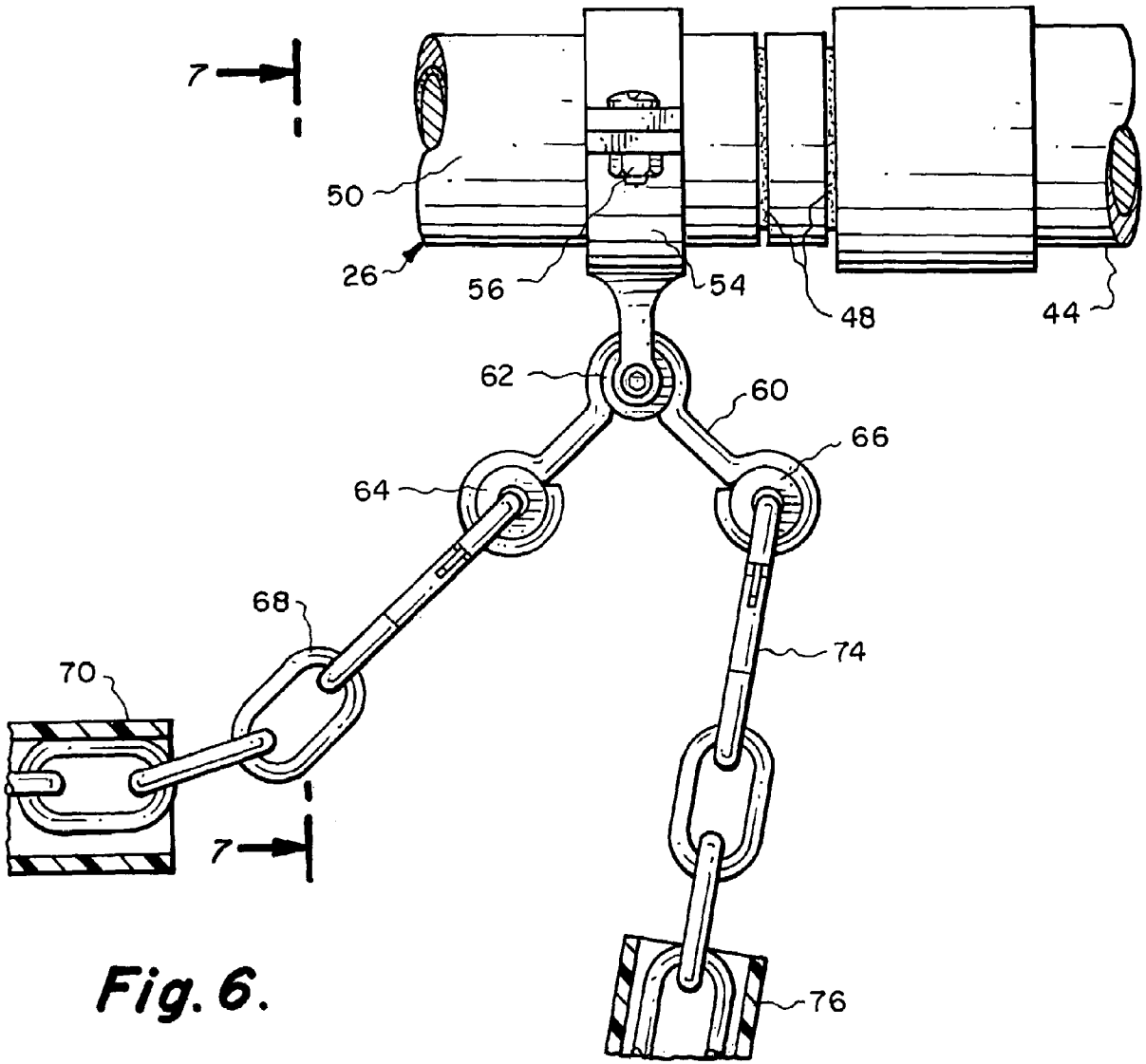
FIG. 6 is an enlarged view taken along line 6—6 of FIG. 1 showing clearly the pivot mounting arrangement of the side frame members and the safety member relative to the top rail of the swing apparatus of the present invention.
Figure 7:
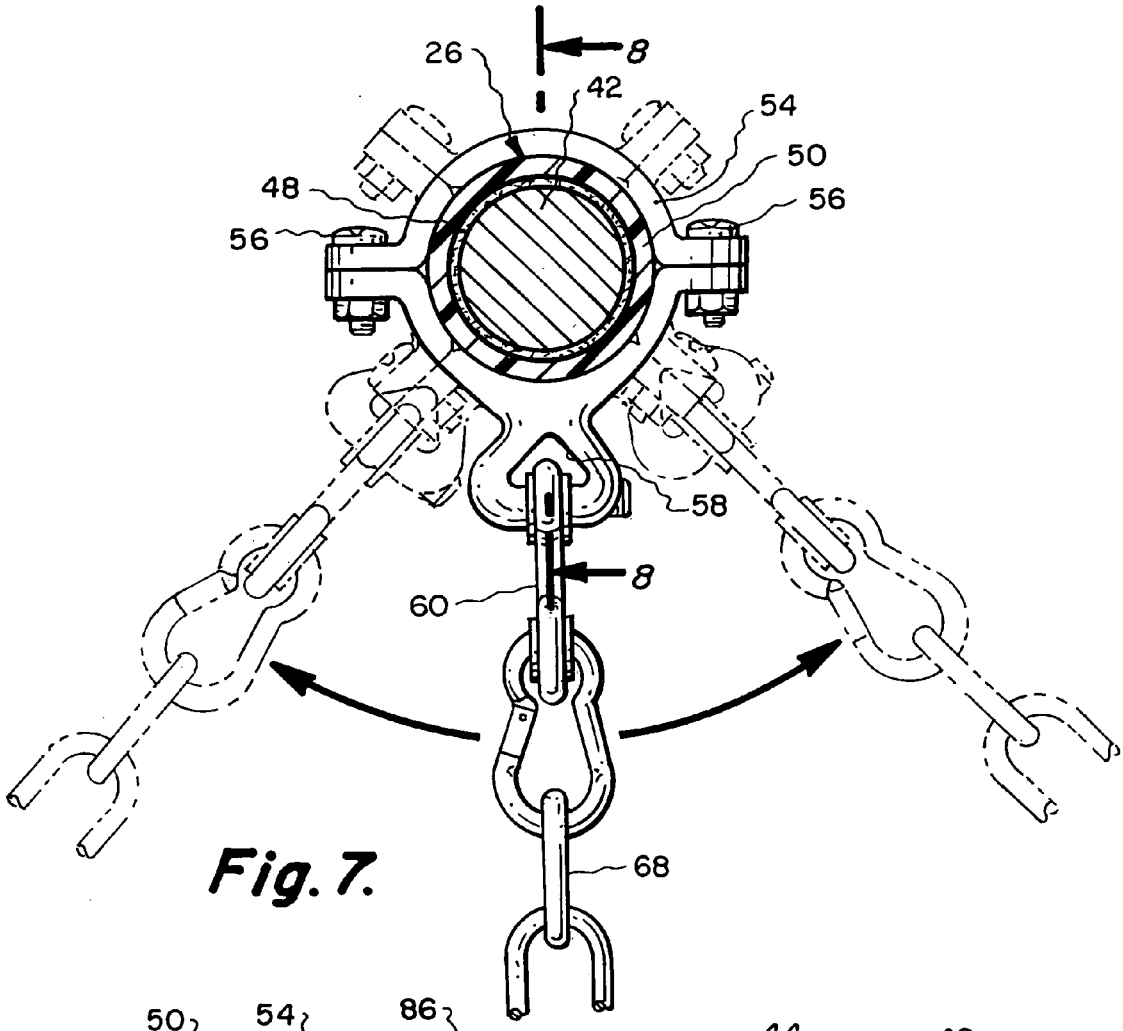
FIG. 7 is a view partly in cross-section taken along line 7—7 of FIG. 6 depicting the pivotable movement of the top rail which occurs when the elongated board is moved longitudinally relative to the supporting frame.
Figure 8:
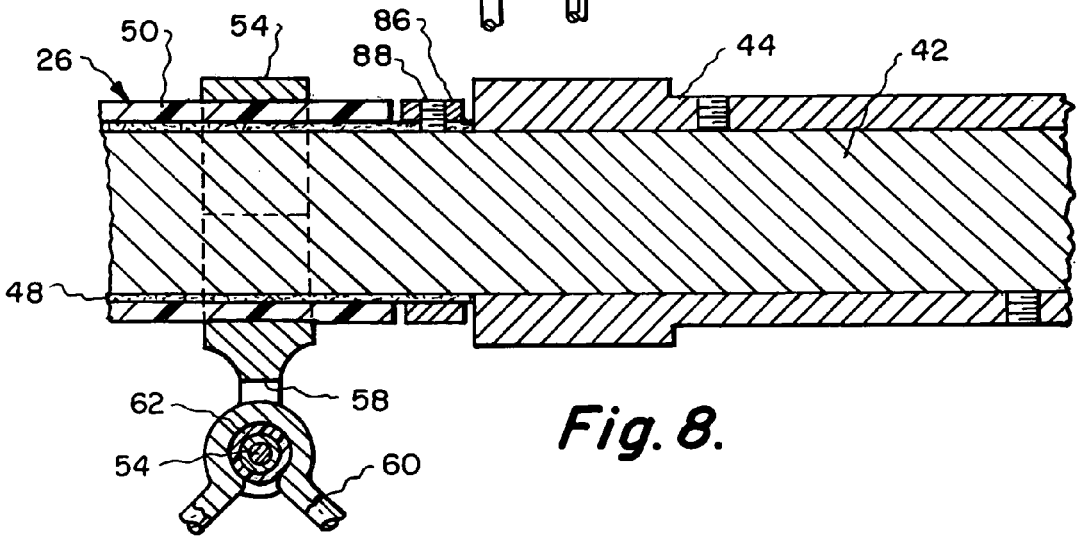
FIG. 8 is a cross-sectional view taken along line 8—8 of FIG. 7.
Figure 10:
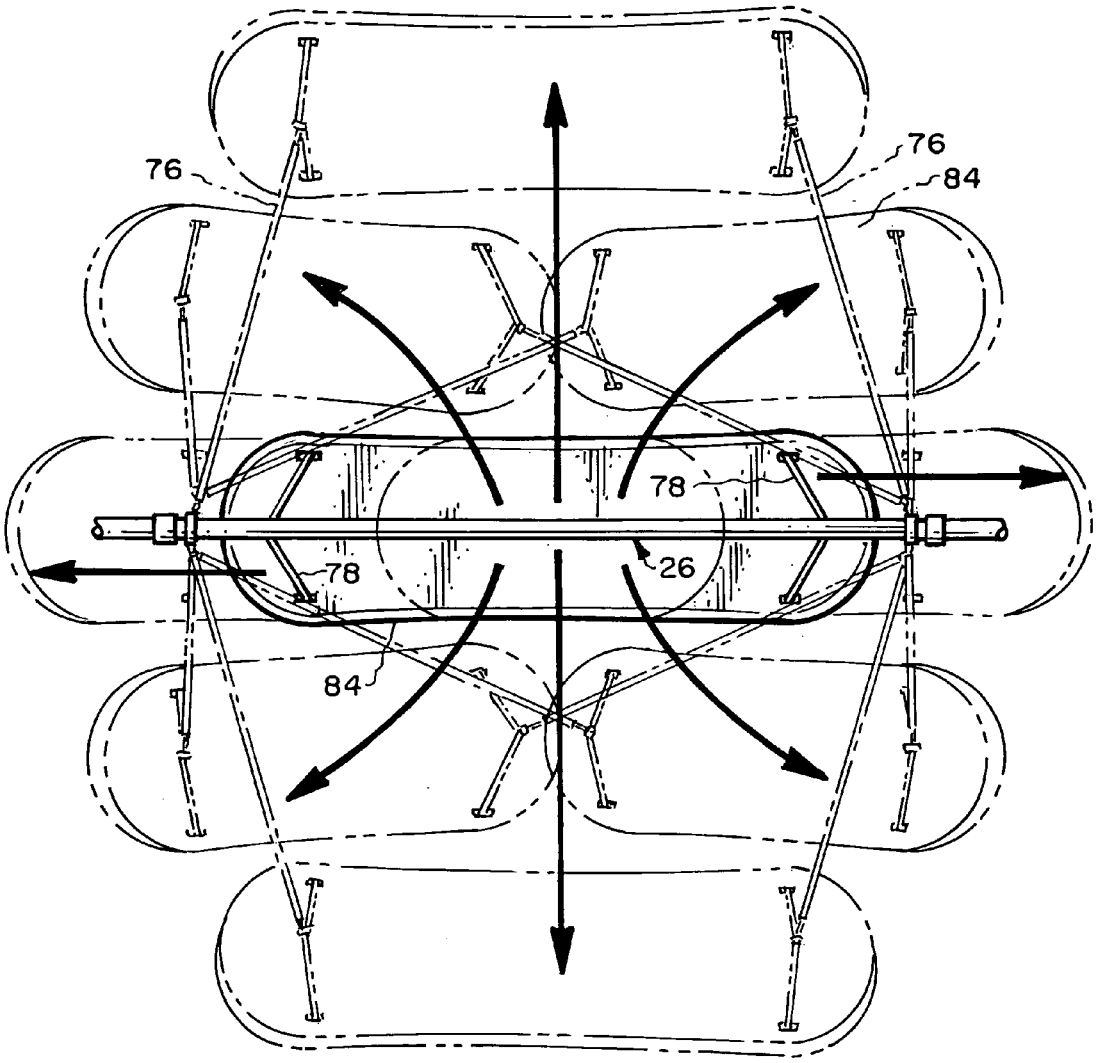
FIG. 10 is a top plan diagrammatic view showing the elongated board within the frame depicting its different positions that the elongated board can be moved into relative to the frame.

Each L-shaped member 60 is to be connected with a chain 74 with it being understood that there are two in number of the chains 74. An ending link of each chain 74 is permitted free pivotable movement relative to the L-shaped member 60 by means of its respective bearing 66. Each of the chains 74 are basically identical in length and in configuration. Each of the chains 74 are passed through a tube 76. The lower ending link of each chain 74 connects with a strap 78. Each end of each strap 78 connects to a link 80 with it being understood that there are four in number of the links 80. Each strap 78 includes an adjustment buckle 77 which can be used to shorten or lengthen strap 78. Each link 80 is mounted within a hole 82 formed within an elongated board 84. It is to be noticed that by referring specifically to FIG. 4 that within each end of the board 84 the holes 82 are inclined about fifteen degrees from vertical in a direction toward each other. The reason for this is to accommodate to the acute angled shape of the strap 78 that is assumed when it is connected to the chain 74. The acute angled relationship is shown in FIG. 2.

Each link 80 within its respective hole 82 connects to an eyelet fastener 90 which connects with a bearing 81. The link 80 is capable of a limited amount of movement relative to the eyelet fastener 90. The eyelet fastener 90 is fixedly mounted to a skeleton member 92. The skeleton member 92 is tubular in construction and will generally comprise plastic, metal or fiberglass. Skeleton member 92 assumes an elongated, rounded ended, configuration which is narrowed in its center, as is readily apparent by observing of FIG. 3. Fixedly attached between the longitudinal ends and the skeleton member 92 is a longitudinal brace 94. Covering the skeleton member 92 and the longitudinal brace 94 is an expandable plastic foam 96. The plastic foam 96 includes a protective, outer skin 98 composed of two or more thin layers of foam or other plastic.

The rider 72 is to place his or her feet on the upper surface of the elongated board 84. The rider 72 by moving his or her weight can cause the board 84 to be moved within the confines of the air space 100 which is defined by the side frame members 22 and 24 and the top rail 26. The rider 72 can move fore and aft and lateral to the different phantom positions depicted in FIG. 10. This riding by the rider 72 is to resemble the movements that are encountered within the sports of surfing or snowboarding.

Figure 11:
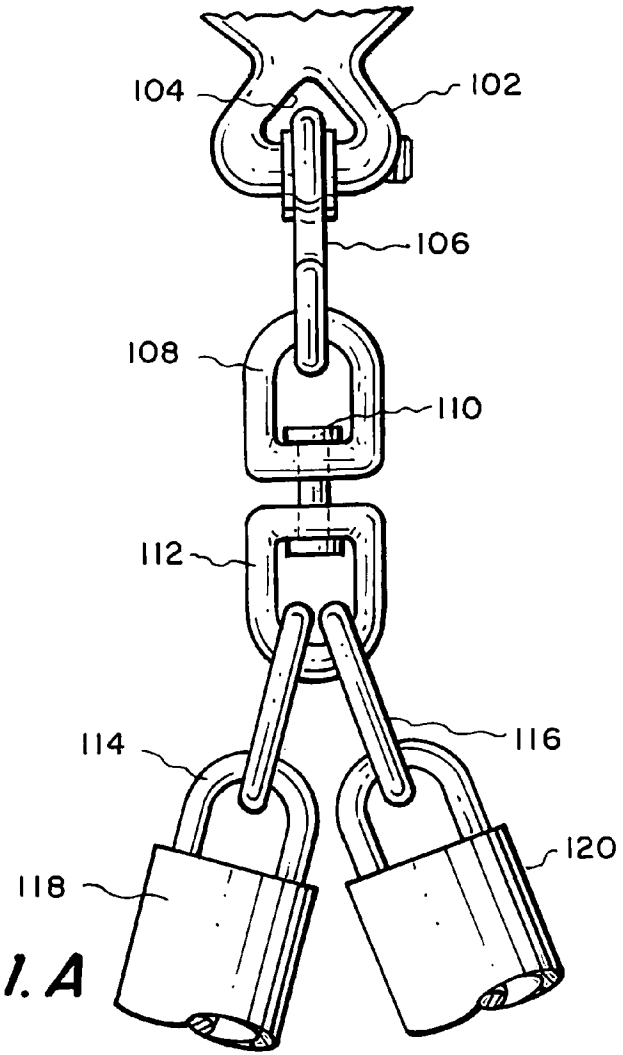
FIG. 11 is a front elevational view similar to FIG. 1 but of a modified form of swing apparatus of the present invention.
Figure 11:
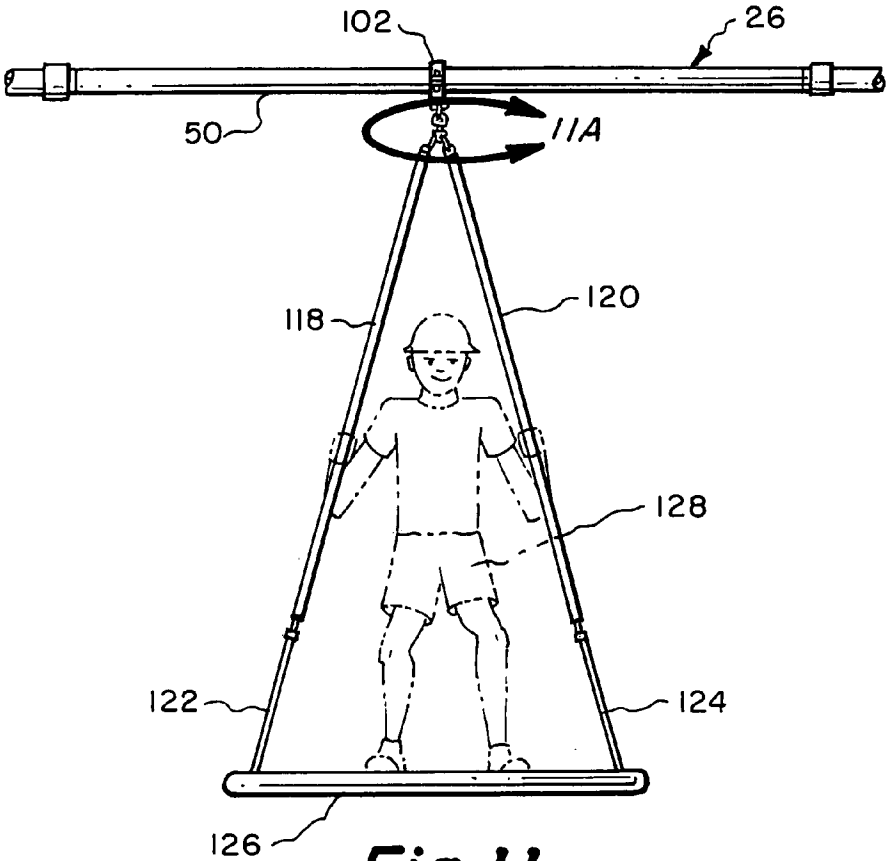

Referring particularly to FIG. 11, there is shown a modified version of the present invention which utilizes the same top rail 26 and the outer tube 50. However, instead of there being two in number of the support brackets 52 and 54, there is only a single support bracket 102. The support bracket 102 includes a hole 104, and within hole 104 is pivotally mounted a link 106. The link 106 in turn connects to a cross link 108 which in turn is mounted on a pin 110. Pin 110 connects to attaching link 112. Mounted in conjunction with attaching link 112 are a pair of chains 114 and 116. Chain 114 is mounted within a bendable, plastic tube 118 and chain 116 is mounted within a bendable, plastic tube 120. The chain 118 connects to a strap 122. Chain 120 connects to a strap 124. The straps 122 and 124 are mounted to the elongated board 126 in a manner that is basically identical to what was previously described in relation to the basic embodiment 20. The rider 128 is to stand on the board 126 and is to grasp onto the tubes 118 and 120 and again by shifting of one's weight can cause swinging movement of the elongated board 126.

Figure 12:
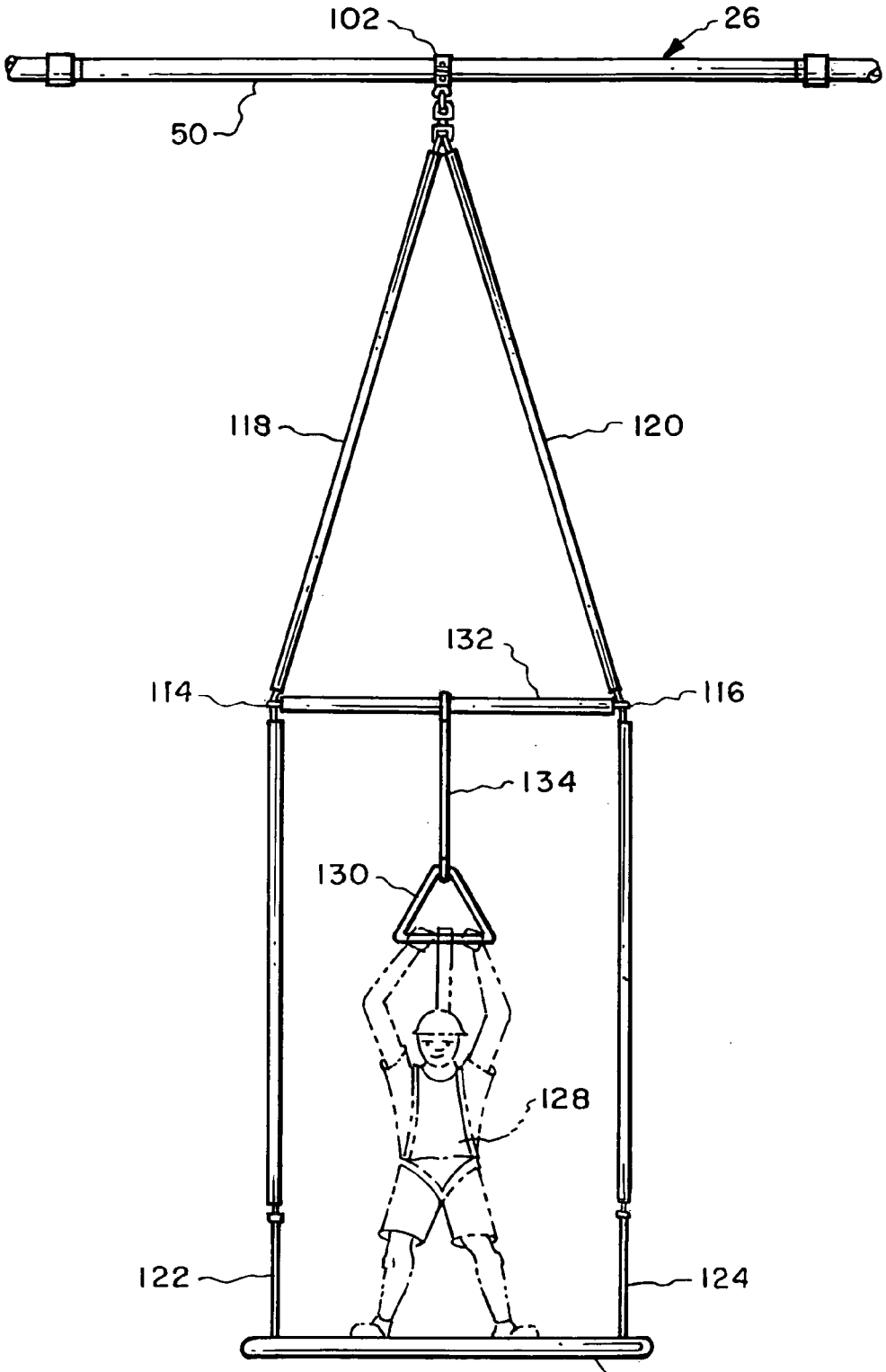
FIG. 12 is a front elevational view of a further modified form of swing apparatus of the present invention.

Referring particularly to FIG. 12, there is shown a modified version of the subject invention with numerals being utilized to refer to the similar parts in relation to FIG. 11. The main distinction in FIG. 12 is that the rider 128, when standing on the board 126, is to be able to grasp onto a trapeze bar 130. The trapeze bar 130 is supported by a rigid steel crossbar 132 which extends between the chains 114 and 116 and is located at a greater height above the rider 128 as opposed to FIG. 1. The trapeze bar 130 is connected to the crossbar 132 by a connecting member 134 which could comprise a strap, chain or even a solid bar. The connecting member 134 is capable of pivoting movement relative to the crossbar 132 or the crossbar 132 and is connected to the chains 114 and 116 by an eyelet link at each side thereof. Again, the rider 128 is to manipulate the swinging movement by moving of his or her weight in order to create the swinging movement of the embodiment shown in FIG. 12. The embodiment shown in FIG. 12 requires a more advanced rider than what is shown in FIG. 11 or what is shown in FIG. 1. The rider 128 can wear a harness.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A board swing apparatus comprising:

a frame comprising a pair of spaced apart, somewhat flexible, side frame members which are to be mounted on a supporting surface and a top rail member which connects between said side frame members, said top rail member to be spaced from the supporting surface forming an air space therebetween which is also located between said side frame members;

an elongated board having a first end and a second end which is mounted within said air space and is spaced from the supporting surface;

a first flexible support attached to said first end, a second flexible support attached to said second end, said first flexible support pivotally mounted by first pivot means to said top rail, said second flexible support pivotally mounted by second pivot means to said top rail;

a safety member extending between said first flexible support and said second flexible support, said safety member being mounted to both said first pivot means and said second pivot means, said safety member adapted to be grasped by a human standing on said elongated board while swinging relative to said frame; and said first pivot means includes a first L-shaped member attached to both said first flexible support and said safety member, said second pivot means includes a second L-shaped member attached to both said second flexible support and said safety member, both said first and said second L-shaped members being mounted by a separate bearing to said top rail.

2. The board swing apparatus as defined in claim 1 wherein:

said safety member being flexible.

3. The board swing apparatus as defined in claim 1 wherein both said first pivot means and said second pivot means is constructed as follows:

said pivot means permit both said first flexible support and said second flexible support to pivot in a first plane and a second plane which is perpendicular to said first plane, said first plane permits side-to-side directional movement of said elongated board, said second plane permits longitudinal movement of said elongated board.

4. The board swing apparatus as defined in claim 1 wherein:

both said first flexible support and said second flexible support include a combination of a chain and a strap.

5. The board swing apparatus as defined in claim 1 wherein:

said elongated board being constructed of an interior tubular member frame covered with an expandable plastic foam.

6. A board swing apparatus comprising:

a frame comprising a pair of spaced apart somewhat flexible, side frame members which are to be mounted on a supporting surface and a top rail member which connects between said side frame members, said top rail member to be spaced from the supporting surface forming an air space therebetween which is also located between said side frame members;

an elongated board having a first end and a second end which is mounted within said air space and is spaced from the supporting surface;

a first flexible support attached to said first end, a second flexible support attached to said second end, said first flexible support pivotally mounted by first pivot means to said top rail, said second flexible support pivotally mounted by second pivot means to said top rail;

a safety member extending between said first flexible support and said second flexible support, said safety member being mounted to both said first pivot means and said second pivot means, said safety member adapted to be grasped by a human standing on said elongated board while swinging relative to said frame;

said safety member being flexible; and said safety member being constructed of a flexible tube through which is conducted a chain.

7. A board swing apparatus comprising:

a frame comprising a pair of spaced apart, somewhat flexible, side frame members which are to be mounted on a supporting surface and a top rail member which connects between said side frame members, said top rail member to be spaced from the supporting surface forming an air space therebetween which is also located between said side frame members;

an elongated board having a first end and a second end which is mounted within said air space and is spaced from the supporting surface;

a first flexible support attached to said first end, a second flexible support attached to said second end, said first flexible support pivotally mounted by first pivot means to said top rail, said second flexible support pivotally mounted by second pivot means to said top rail;

a safety member extending between said first flexible support and said second flexible support, said safety member being mounted to both said first pivot means and said second pivot means, said safety member adapted to be grasped by a human standing on said elongated board while swinging relative to said frame; and said top rail pivots relative to said side frame members.

* * * * *